US006722915B1

(12) United States Patent
McAlonis et al.

(10) Patent No.: US 6,722,915 B1
(45) Date of Patent: Apr. 20, 2004

(54) ELECTRICAL CONNECTOR FOR CONNECTING CIRCUIT BOARDS TO FLAT FLEXIBLE CABLES

(75) Inventors: Matthew R. McAlonis, Elizabethtown, PA (US); Troy E. Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/331,288

(22) Filed: Dec. 30, 2002

(51) Int. Cl.[7] ..... H01R 12/24

(52) U.S. Cl. ..... 439/498; 439/493; 439/637; 439/857

(58) Field of Search ..... 439/493, 494, 439/495, 498, 67, 637, 857

(56) References Cited

U.S. PATENT DOCUMENTS 3,966,295 A * 6/1976 Hyland et al. ..... 439/498
4,959,030 A * 9/1990 Tatebe et al. ..... 439/67
5,501,610 A * 3/1996 Ikemoto ..... 439/498
6,210,174 B1 * 4/2001 Pei et al. ..... 439/67
6,250,966 B1 * 6/2001 Hashimoto et al. ..... 439/631

* cited by examiner

*Primary Examiner*—Tho D. Ta

(57) ABSTRACT

An electrical connector is provided including an electrical connector having a housing with a front end configured to receive a circuit board and a rear end configured to receive at least one flexible cable. The electrical connector includes top and bottom contacts retained in alignment along a vertical axis in corresponding channels in the housing. At least one of the top and bottom contacts has a first contact prong configured to engage the circuit board and a second contact prong configured to engage the at least one flexible cable. The electrical connector includes a stuffer received at the second end of the housing that is configured to retain the at least one flexible cable in contact with the second contact prong.

21 Claims, 5 Drawing Sheets

10
22
26
86
174
170
102
166
142
119
134
138
110
38
130
126
78
178
14
74
106
94
158
18
146
98
84
82
150
122
154
118
B

ELECTRICAL CONNECTOR FOR CONNECTING CIRCUIT BOARDS TO FLAT FLEXIBLE CABLES

BACKGROUND OF THE INVENTION

The present invention generally relates to an electrical connector that connects printed circuit boards to cables and more particularly relates to an electrical connector that connects a daughter board to a flexible cable.

In certain computer applications, such as servers, large circuit boards called motherboards are retained within a server cabinet and are electrically connected to several smaller circuit boards called daughter cards. The terms card and board shall be used interchangeably hereafter. Usually a power supply is provided in the server cabinet. The daughter card is connected to a sensing location within the power supply by an electrical connector. The sensing location monitors the power supply throughout the motherboard within the power supply to determine where the electrical power should be routed within the server.

Therefore, the typical electrical connector includes a housing having a card slot that receives the daughter card at a first end. The housing carries power contacts and signal contacts which are generally similar in size. The power and signal contacts extend through a second end of the housing to power and signal wires, respectively. The power wires extend to the power supply and the motherboard within the server cabinet, and the signal wires extend to the sensing location.

The power contacts are retained in a group on one side of the housing in parallel channels that are perpendicular to the card slot. Each channel carries a top power contact aligned with a corresponding bottom power contact along a vertical axis. The corresponding top and bottom power contacts each have a deflectable contact prong at a first end. The contact prongs of the corresponding top and bottom power contacts extend toward each other into the card slot. Each top and bottom power contact also has a barrel that extends out of the second end of the housing and is crimped around a power wire. The top and bottom power contacts are preloaded within the housing apart from each other along the vertical axis within the channels. When the daughter card is inserted into the card slot, the daughter card biases the top and bottom power contacts in a channel away from each other along the vertical axis such that the top and bottom power contacts press firmly against electrical traces on the top and bottom sides of the daughter card. Thus, the power contacts electrically connect the daughter card to the power supply.

The signal contacts are retained in a group next to the power contacts in parallel channels that are perpendicular to the card slot. Each channel carries a top signal contact aligned with a corresponding bottom signal contact along the vertical axis. The corresponding top and bottom signal contacts each have a deflectable contact prong at a first end. The contact prongs of the corresponding top and bottom signal contacts extend toward each other into the card slot. Each top and bottom signal contact also has a barrel that extends out of the second end of the housing and is crimped around a signal wire. When the daughter card is inserted into the card slot, the daughter card deflects the contact prongs of corresponding top and bottom signal contacts away from each other along the vertical axis such that the contact prongs press firmly against electrical traces on the top and bottom sides of the daughter card. Thus, the signal contacts electrically connect the daughter card to the electronic sensor.

The typical card-to-wire electrical connector suffers from a number of drawbacks. First, because the power and signal contacts are wide and have a large pitch across the first end of the housing, the electrical connector takes up a great deal of space within the power supply such that the power supply is larger and takes up a great deal of space within the server cabinet. The server cabinet is already tightly packed with printed circuit boards, thus the electrical connector takes up space that could be used for additional printed circuit boards. The electrical connector also blocks air that is forced through the server cabinet to cool the power supply. The power and signal wires extending from the electrical connector take up space within the power supply and server cabinet as well. Additionally, a tool is required to connect the power and signal wires to the power and signal contacts, respectively. The tool is bulky and thus difficult to use in the server cabinet or any other constrained space. Further, it is inconvenient for an operator to always have the available tool to connect the power and signal wires to the electrical connector. Finally, because all the contacts are crimped about the wires, the wires cannot be disconnected from the electrical connector without first removing the contacts from the housing.

A need remains for an electrical connector that overcomes the above problems and addresses other concerns experienced in the prior art.

BRIEF SUMMARY OF THE INVENTION

Certain embodiments of the present invention include an electrical connector having a housing with a front end configured to receive a circuit board and a rear end configured to receive at least one flexible cable. The electrical connector includes top and bottom contacts retained in alignment along a vertical axis in corresponding channels in the housing. At least one of the top and bottom contacts has a first contact prong configured to engage the circuit board and a second contact prong configured to engage the at least one flexible cable. The electrical connector includes a stuffer received at the second end of the housing that is configured to retain the flexible cable in contact with the second contact prong.

Figure 1:
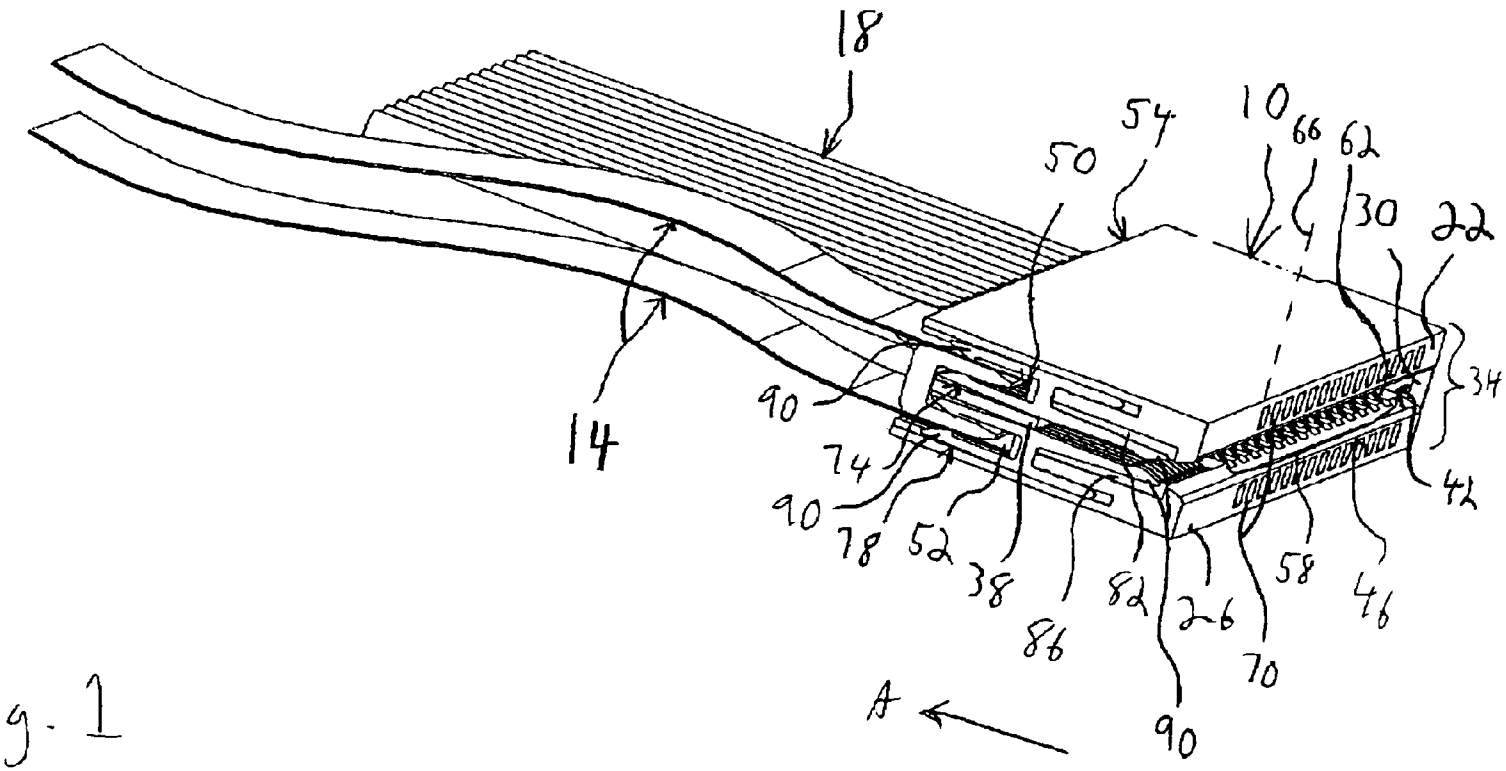
FIG. 1 illustrates an isometric view of an electrical connector with a cutaway side portion partially exposing flat flexible cables (FFCs) and power wires formed according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates a cutaway side isometric view of an electrical connector 10 formed according to an embodiment of the present invention engaging flat flexible cables (FFCs) 14 and power wires 18. The electrical connector 10 includes an insulated box-shaped housing 34 with a rectangular top portion 22 and a rectangular bottom portion 26 connected by side walls 30 and a divider wall 38 (only one side wall 30 is shown however because of the cutaway view). The housing 34 has a card slot 42 between the top and bottom portions 22 and 26 at a front end 46 and, at a rear end 54, a top FFC slot 50 between the top portion 22 and divider wall 38 and a bottom FFC slot 52 between the bottom portion 26 and the divider wall 38.

The housing 34 carries power contacts 58, each of which has beams 62 aligned opposite each other along a vertical axis 66 at the front end 46. The beams 62 are formed to be biased toward each other along the vertical axis 66. The oppositely aligned beams 62 have catches (not shown) that are preloaded in retention cavities 70 such that the beams 62 are biased away from each other. Each power contact 58 has a barrel (not shown) that receives and is crimped about a power wire 18. The power wires 18 extend to a power supply or a motherboard (not shown).

The housing 34 also carries planar H-shaped top and bottom signal contacts 74 and 78. The top signal contacts 74 are retained in parallel top channels 82 and the bottom signal contacts 78 are retained in parallel bottom channels 86. Each top signal contact 74 is aligned opposite a corresponding bottom signal contact 78 along the vertical axis 66. The top and bottom signal contacts 74 and 78 have contact prongs 90 retained proximate the front end 46 and contact prongs 90 retained proximate the rear end 54. The contact prongs 90 at the rear end 54 engage electrical traces (not shown) extending along the length of the FFCs 14. The FFCs 14 extend to an electronic sensor (not shown) that monitors the supply of power.

In operation, the electrical connector 10 is connected to a computer application such as a server (not shown) having printed circuit boards in a server cabinet. The server cabinet may contain, by way of example only, a motherboard (not shown) and daughter cards (not shown). The electrical connector 10 receives a daughter card in the card slot 42. As the daughter card is inserted into the card slot 42, in the direction of arrow A, the daughter card pushes the oppositely aligned beams 62 of each power contact 58 away from each other along the vertical axis 66 such that (tie beams 62 press firmly against both sides of the daughter card. The daughter card has electrical traces thereon that engage the beams 62 of the power contacts 58 such that electrical power is provided to the daughter card and thus the motherboard through the power wires 18 by the power supply. Likewise, the daughter card pushes the oppositely aligned contact prongs 90 of the top and bottom signal contacts 74 and 78 at the front end 46 away from each other such that the contact prongs 90 press firmly against both sides of the daughter card. The daughter card has electrical traces thereon that engage the contact prongs 90 of the top and bottom signal contacts 74 and 78 such that the electronic sensor monitors the power supply to the motherboard through the FFCs 14.

Figure 4:
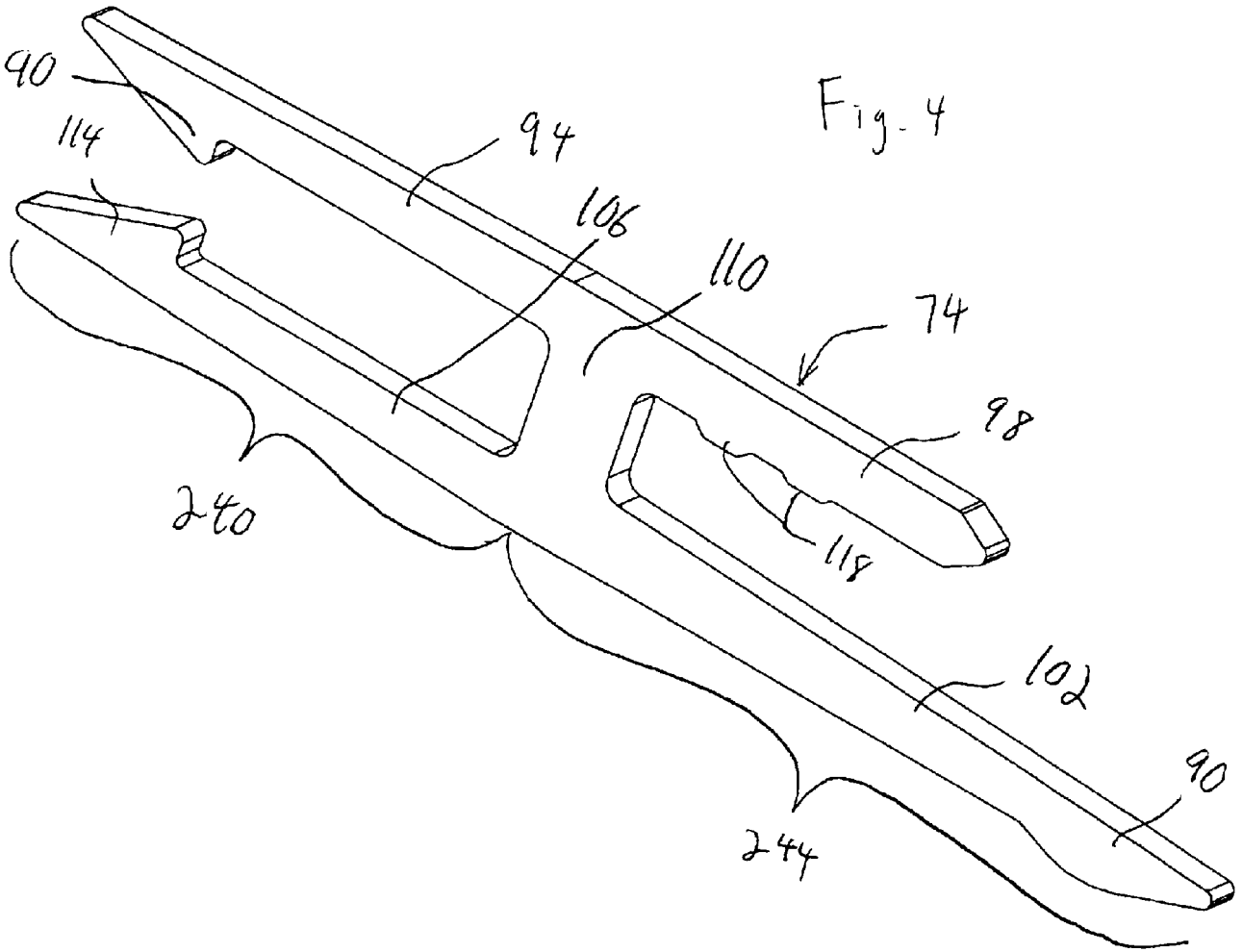
FIG. 4 illustrates an isometric view of a top signal contact formed according to an embodiment of the present invention.

FIG. 4 illustrates an isometric view of a top signal contact 74 formed according to an embodiment of the present invention. The top signal contact 74 is generally similar to the bottom signal contact 78 (FIG. 1). The H-shaped top signal contact 74 is defined by first and second U-shaped portions 240 and 244. The first U-shaped portion 240 has a top contact leg 94 formed with a bottom retention leg 106, and the second U-shaped portion 244 has a top retention leg 98 formed with a bottom contact leg 102. An intermediate bar 110 is formed with, and connects, the first and second U-shaped portions 240 and 244. The bottom contact leg 102 has a rounded contact prong 90, and the bottom retention leg 106 has a triangular retention prong 114. The top retention leg 98 has retention barbs 118, and the top contact leg 94 has a triangular contact prong 90.

Figure 2:
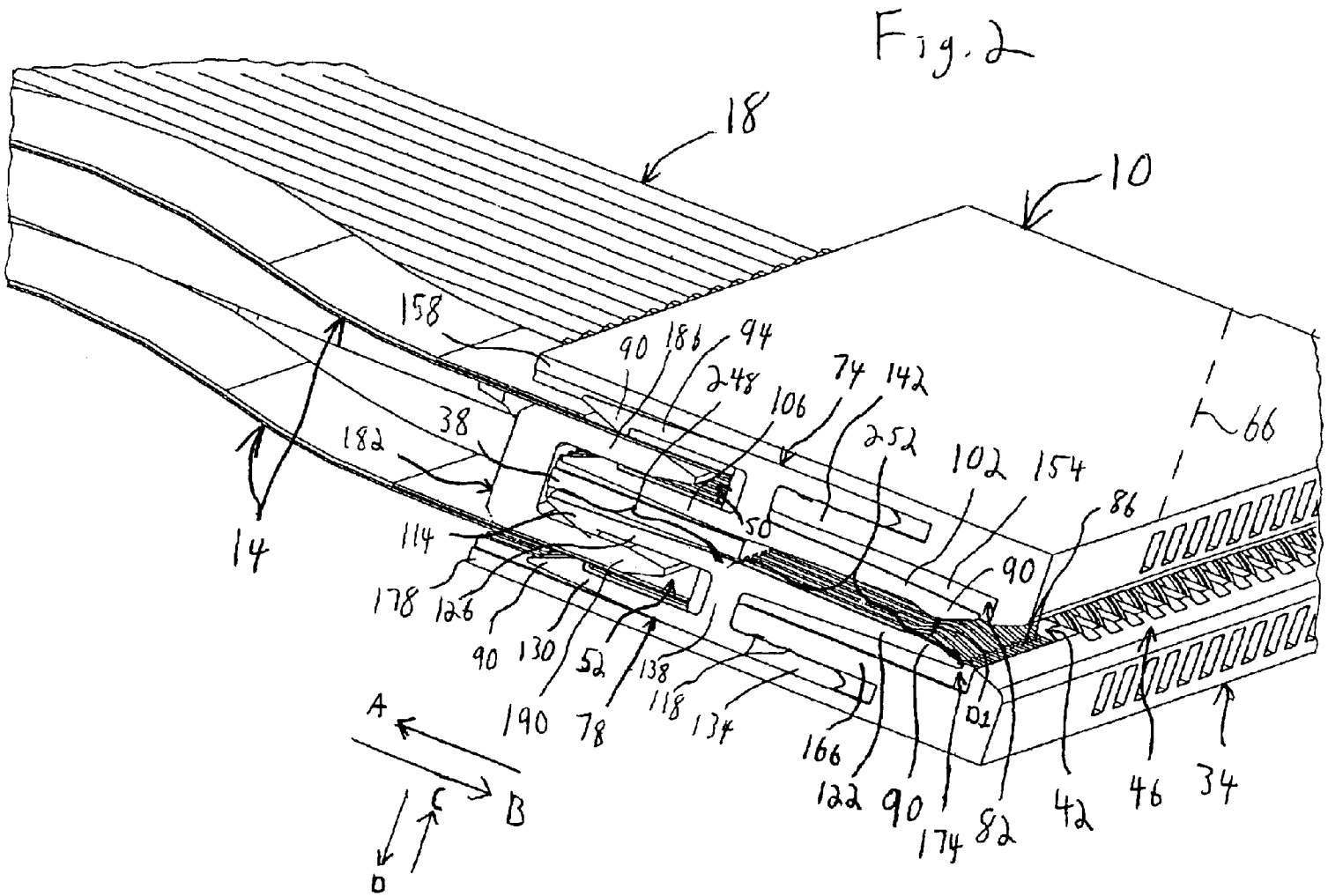
FIG. 2 illustrates a more detailed isometric view of the electrical connector, FFCs, and power wires of FIG. 1.

FIG. 2 illustrates a more detailed isometric view of the electrical connector 10, FFCs 14, and power wires 18 of FIG. 1. The H-shaped bottom signal contact 78 likewise is defined by first and second U-shaped portions 248 and 252. The first U-shaped portions 248 has a bottom contact leg 130 formed with a top retention leg 126, and the second U-shaped portion 252 has a top contact leg 122 formed with a bottom retention leg 134. An intermediate bar 138 is formed with, and connects, the first and second U-shaped portions 248 and 252. The bottom retention leg 134 has retention barbs 118, and the bottom contact leg 130 has a triangular contact prong 90. The top contact leg 122 has a rounded contact prong 90, and the top retention leg 126 has a triangular retention prong 114.

Figure 5:
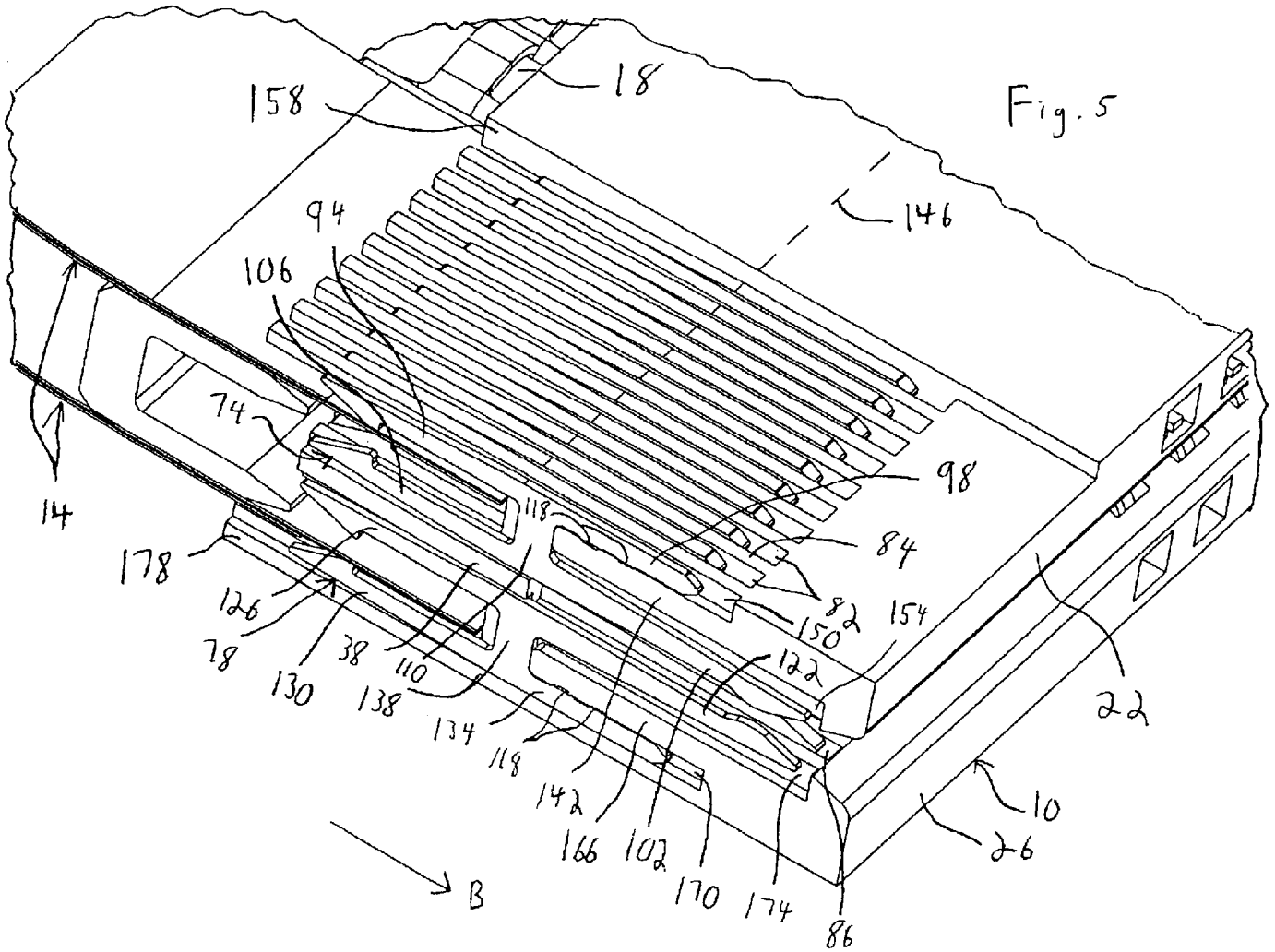
FIG. 5 illustrates a cutaway isometric view of the electrical connector, FFCs, and power wires of FIG. 1.

FIG. 5 illustrates a cutaway isometric view of the electrical connector 10, FFCs 14, and power wires 18 of FIG. 1. The top channels 82 are separated from each other by channel walls 84. The divider wall 38 and a top retention wall 142 extend perpendicularly through the channel walls 84 along a longitudinal axis 146. The top retention wall 142 defines a retention cavity 150 and a contact cavity 154 within the top channel 82. The retention cavity 150 receives the top retention leg 98 and the contact cavity 154 receives the bottom contact leg 102 such that the intermediate bar 110 engages the top retention wall 142. The top contact leg 94 and the bottom retention leg 106 are retained within the top channel 82 between the divider wall 38 and a top wall 158 of the top portion 22. The top retention wall 142 frictionally engages the retention barbs 118 of the top retention leg 98 when the top signal contact 74 is inserted into the top channel 82 in the direction of arrow B. Thus, the top retention leg 98 retains the top signal contact 74 within the top channel 82.

Likewise, the bottom channels 86 are separated from each other by the channel walls 84. The divider wall 38 and a bottom retention wall 166 extend perpendicularly through the channel walls 84 along the longitudinal axis 146. The bottom retention wall 166 defines a retention cavity 170 and a contact cavity 174 within the bottom channel 86. The retention cavity 170 receives the bottom retention leg 134 and the contact cavity 174 receives the top contact leg 122 such that the intermediate bar 138 engages the bottom retention wall 166. The top retention leg 126 and the bottom contact leg 130 are retained within the bottom channel 86 between the divider wall 38 and a bottom wall 178 of the bottom portion 263 The bottom retention wall 166 frictionally engages the retention barbs 118 of the bottom retention leg 134 when the bottom signal contact 78 is inserted into the bottom channel 86 in the direction of arrow B. Thus, the bottom retention leg 134 retains the bottom signal contact 78 within the bottom channel 86.

Returning to FIG. 2, each top signal contact 74 in a top channel 82 is aligned with a corresponding bottom signal contact .78 in a bottom channel 86 such that the contact prongs 90 of the bottom contact leg 102 of the top signal contact 74 and the top contact leg 122 of the bottom signal contact 78 are oppositely aligned along the vertical axis 66. Similarly, the top contact leg 94 and the bottom retention leg 106 of the top signal contact 74 and the top retention leg 126 and the bottom contact leg 130 of the bottom signal contact 78 are aligned with each other along the vertical axis 66.

The contact prongs 90 of the bottom contact leg 102 and the top contact leg 122 extend toward each other into the card slot 42 proximate the front end 46 of the housing 34 and are separated by a vertical distance D1 that is less than the thickness of the daughter card. As the daughter card is inserted into the card slot 42, in the direction of arrow A, the daughter card engages the contact prongs 90 of the vertically aligned bottom, contact leg 102 and top contact leg 122. Because the daughter card is thicker than the distance D1, the daughter card pushes the vertically aligned contact prongs 90 away from each other such that the flexible bottom contact leg 102 of the top signal contact 74 is pushed in the direction of arrow C into the contact cavity 154 of the top channel 82 toward the top retention wall 142 and the flexible top contact leg 122 of the bottom signal contact 78 is pushed in the direction of arrow D into the contact cavity 174 of the bottom channel 86 toward the bottom retention wall 166. Thus, the contact prongs 90 of the top and bottom contact legs 122 and 102 resistibly engage the top and bottom sides of the daughter card, respectively.

The daughter card has electrical traces on each side that are oriented to engage the contact prongs 90 of the top and bottom, contact legs 122 and 102 when the daughter card is inserted into the card slot 42. The contact prongs 90 of the top contact legs 122 contact the electrical traces on the bottom side of the daughter card and the contact prongs 90 of the bottom contact legs 102 contact the electrical traces on the top side of the daughter card. Thus, the top and bottom signal contacts 74 and 78 are electrically connected to the daughter card.

Figure 3:
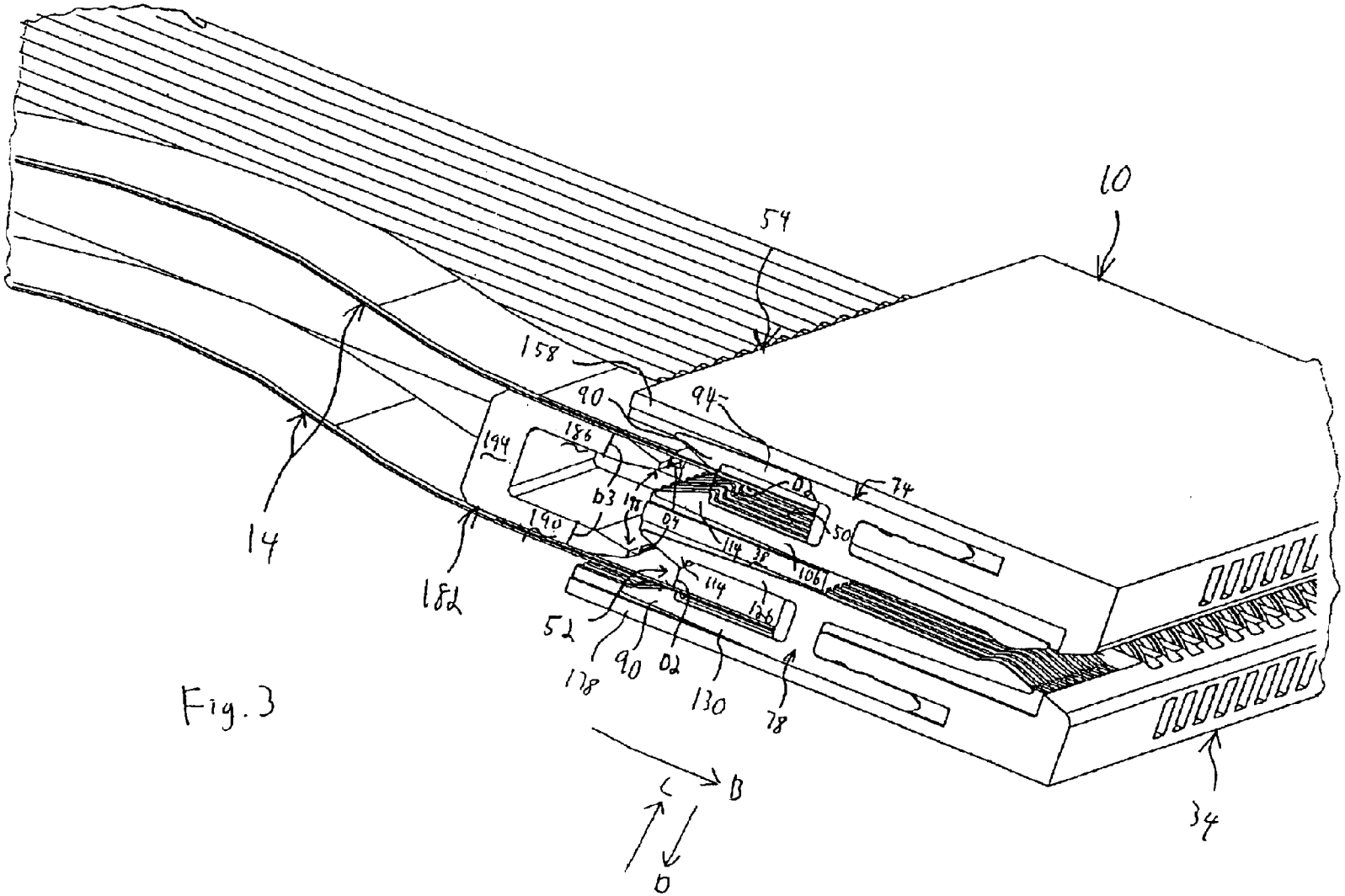
FIG. 3 illustrates an isometric view of an electrical connector with the stuffer removed according to an embodiment of the present invention.

FIG. 3 illustrates an isometric view of the electrical connector 10 with a stuffer 182 removed according to an embodiment of the present invention. In the case of the top signal contact 74, the contact prong 90 of the top contact leg 94 and the retention prong 114 of the bottom retention leg 106 extend toward each other into the top FFC slot 50 proximate the rear end 54 of the housing 34 and are separated by a vertical distance D2. Similarly, in the case of the bottom signal contact 78, the contact prong 90 of the bottom contact leg 130 and the retention prong 114 of the top retention leg 126 extend toward each other into the bottom FFC slot 52 proximate the rear end 54 of the housing 34 and are separated by the vertical distance D2 as well. The top FFC slot 50 receives an FFC 14 such that the electrical traces on the FFC 14 engage the contact prongs 90 of the top contact legs 94 of the top signal contacts 74. The bottom FFC slot 52 receives an FFC 14 such that the electrical traces on the FFC 14 engage the contact prongs 90 of the bottom contact legs 130 of the bottom signal contacts 78.

The electrical connector 10 includes the U-shaped stuffer 182. The stuffer 182 is insulated and has parallel top and bottom retention walls 186 and 190 formed with a base wall 194. The top and bottom retention walls 186 and 190 each have a maximum thickness of D3 that tapers down to a thickness of D4 at insertion ends 198. The distance D2 is greater than the distance D4 but smaller than the distance D3. When an FFC 14 is fully inserted into both the top and bottom FFC slots 50 and 52, the stuffer 182 is placed in the direction of arrow B such that the top retention wall 186 enters the top FFC slot 50 between an FFC 14 and the retention prong 114 of the bottom retention leg 106 and the bottom retention wall 190 enters the bottom FFC slot 52 between an FFC 14 and the retention prong 114 of the top retention leg 126.

Because the distance D4 is less than the distance D2, the insertion ends 198 of the top and bottom retention walls 186 and 190 initially slide without resistance between the top contact leg 94 and the bottom retention leg 106 of the top signal contact 74 and the top retention leg 126 and the bottom contact leg 130 of the bottom signal contact 78, respectively. However, as the stuffer 182 gradually slides further in the direction of arrow B, the thickness D3 of the top retention wall 186 pushes the top contact leg 94 in the direction of arrow C toward the top wall 158 and pushes the bottom retention leg 106 in the direction of arrow D toward the divider wall 38. Likewise, the thickness D3 of the bottom retention wall 190 pushes the top retention leg 126 in the direction of arrow C toward the divider wall 38 and pushes the bottom contact leg 130 in the direction of arrow D toward the bottom wall 178. When the stuffer 182 is fully inserted into the top and bottom FFC slots 50 and 52, the retention prong 114 of the bottom retention leg 106 of the top signal contact 74 resistibly engages the top retention wall 186 and the retention prong 114 of the top retention leg 126 of the bottom signal contact 78 resistibly engages the bottom retention wall 190. Thus, an FFC 14 is firmly retained in contact with the contact prongs 90 of the top contact legs 94 of the top signal contacts 74 and an FFC 14 is firmly retained in contact with the contact prongs 90 of the bottom contact legs 130 of the bottom signal contact 78.

The distance D2 is greater than the thickness of an FFC 14, thus, an FFC 14 is inserted into the top and bottom FFC slots 50 and 52 with minimal insertion force and no buckling. The FFCs 14 then are secured into contact with the contact prongs 90 of the top contact legs 94 and the contact prongs 90 of the bottom contact legs 130 by placing the stuffer 182 into the top and bottom FFC slots 50 and 52.

Returning to FIG. 2, the stuffer 182 and the FFCs 14 are fully inserted into the top and bottom FFC slots 50 and 52. The FFCs 14 are positioned within the top and bottom FFC slots 50 and 52 such that the electrical traces on the FFCs 14 are aligned with, and firmly contact, the contact prongs 90 of the top contact legs 94 of the top signal contacts 74 and the contact prongs 90 of the bottom contact legs 130 of the bottom signal contacts 78. Thus, the top signal contacts 74 arc electrically connected to an FFC 14 and the bottom signal contacts 78 are electrically connected to an FFC 14. Consequently, the electrical traces on the top side of the daughter card are electrically connected to the electrical traces of an FFC 14 via the top signal contacts 74 and the electrical traces on the bottom side of the daughter card are electrically connected to the electrical traces of an FFC 14 via the bottom signal contacts 78. The electronic sensor is therefore connected to the motherboard and monitors the power supply of the motherboard.

Alternatively, the daughter card may be removed from the card slot 42 in the direction of arrow B such that the daughter card no longer resistibly engages the contact prongs 90 of the bottom contact legs 102 of the top signal contact 74 and the top contact legs 122 of the bottom signal contacts 78. Thus, the bottom contact legs 102 extend in the direction of arrow D away from the top retention wall 142 to their original unbiased position and the top contact legs 122 extend in direction of arrow C away from the bottom retention wall 166 to their original unbiased position. Likewise, the stuffer 182 may be removed from the top and bottom FFC slots 50 and 52 in the direction of arrow A such that the top retention wall 186 no longer resistibly-engages the contact prongs 90 of the top contact legs 94 and the retention prongs 114 of the bottom retention legs 106 and the bottom retention wall 190 no longer resistibly engages the contact prongs 90 of the bottom contact legs 130 and the retention prongs 114 of the top retention legs 126. Thus, the top contact legs 94 extend in the direction of arrow D away from the top wall 158 toward their original unbiased position and the bottom retention legs 106 then extend in the direction of arrow C away from the divider wall 38 to their original unbiased position. Likewise, the bottom contact legs 130 extend in the direction of arrow C away from the bottom wall 178 to their original unbiased position and the top retention legs 126 extend in the direction of arrow D away from the divider wall 38 to their original unbiased position.

The electrical connector of the various embodiments provides several benefits. First, the top and bottom signal contacts are much thinner than the signal contacts of the prior art. Therefore, the signal contacts have a smaller pitch across the longitudinal axis than the prior art signal contacts, which enables more power signals and power cables to be used with the electrical connector or allows for a smaller electrical connector. Also, the signal contacts are connected to the electronic sensor with an FFC instead of several separate wires. The FFC takes up less space than individual wires. Also, the FFC is easier to connect to the signal contacts then wires because no crimping tool is necessary, and the FFC may be detached from the signal contacts without having to replace the signal contacts. Additionally, the stuffer enables an operator to install the FFC into firm contact with contact prongs with minimal insertion force and no buckling of the FFC. Finally, the signal contacts are easy to install into the housing.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claim is:

1. An electrical connector comprising:

a housing having a front end configured to receive a circuit board and a rear end configured to receive at least one flexible cable;

top and bottom contacts retained in alignment along a vertical axis in corresponding channels in said housing, at least one of said top and bottom contacts having a first contact prong configured to engage the circuit board and a second contact prong configured to engage the at least one flexible cable, and wherein said top contact includes a bottom contact leg having said first contact prong and said bottom contact includes a top contact leg having said first contact prong, said first prongs of said bottom contact leg and top contact leg extending toward each other into a card slot at said front end along said vertical axis and being separated by a distance less than the thickness of the circuit board such that the circuit board pushes said bottom contact leg toward a top retention wall and said top contact leg toward a bottom retention wall as said first contact prongs enrage electrical traces on the circuit board; and a stuffer received at said rear end of said housing, said stuffer being configured to retain the at least one flexible cable in contact with said second contact prong.

2. The electrical connector of claim 1, wherein said stuffer includes parallel top and bottom resistance walls having tapered insertion ends, said top and bottom resistance walls biasing the at least one flexible cable and second contact prong against one another.

3. The electrical connector of claim 1, wherein at least one of said top and bottom contacts includes an H-shape partially defined by said first and second contact prongs, and a retention leg that frictionally engages a retention wall in said channel to retain said at least one of said top and bottom contacts therein.

4. The electrical connector of claim 1, wherein at least one of said top and bottom contacts includes an H-shape partially defined by said second contact prong and a retention leg facing one another and spaced apart to frictionally engage said stuffer.

5. The electrical connector of claim 1, wherein said housing includes a top slot at said rear end configured to receive the at least one flexible cable and a top retention wall of said stuffer, said top contact having a top contact leg and a bottom retention leg aligned along said vertical axis in said corresponding channel, said second contact prong extending from said top contact leg into said top slot to engage the at least one flexible cable and a retention prong extending from said bottom retention leg into said top slot to engage said top retention wall.

6. The electrical connector of claim 1, wherein said housing includes a bottom slot at said rear end that receives one of the at least one flexible cable and a bottom retention wall of said stuffer, said bottom contact having a bottom contact leg and top retention leg aligned along said vertical axis in said channel, said second contact prong extending from said bottom contact leg into said bottom slot to engage the at least one flexible cable and a retention prong extending from said top retention leg into said bottom slot to engage said bottom retention wall.

7. The electrical connector of claim 1, wherein said top contact includes a top contact leg and a bottom retention leg aligned along said vertical axis in said corresponding channels, said top contact leg and bottom retention leg being separated by a distance less than the thickness of a top retention wall of said stuffer such that when said top retention wall is placed between said top contact leg and bottom retention leg, said top contact leg is biased toward a top wall and said bottom retention leg is biased toward a divider wall.

8. The electrical connector of claim 1, wherein said bottom contact includes a top retention leg and a bottom contact leg aligned along said vertical axis in said corresponding channel, said top retention leg and bottom contact leg being separated by a distance less than the thickness of a bottom retention wall of said stuffer such that when said bottom retention wall is placed between said top retention leg and said bottom contact leg, said top retention leg is biased toward a divider wall and said bottom contact leg is biased toward a bottom wall.

9. The electrical connector of claim 1, wherein said housing includes a top portion holding said top contact and a bottom portion holding said bottom contact, said top and bottom portions receiving the circuit board therebetween at said front end and being connected by a divider wall at said rear end.

10. The electrical connector of claim 1, wherein the at least one flexible cable includes electrical traces extending the length thereof, the at least one flexible cable being positioned between said stuffer and said second contact prongs such that said second contact prongs engage said electrical traces.

11. The electrical connector of claim 1, wherein said housing retains a power contact in a power contact channel, said power contact being connected to a power wire at said rear end and being configured to contact electrical traces on the circuit board.

12. An electrical connector comprising:

a housing having a front end configured to receive a circuit board and a rear end configured to receive at least one flexible cable;

top and bottom contacts retained in alignment along a vertical axis in corresponding channels in said housing, at least one of said top and bottom contacts having a first contact prong configured to engage the circuit board and a second contact prone configured to engage the at least one flexible cable, and wherein said top contact has a top retention leg with retention barbs and said bottom contact has a bottom retention leg with retention barbs, said top retention leg frictionally engaging a top retention wall with said retention barbs and said bottom retention leg frictionally engaging a bottom retention wall with said retention barbs to retain said top and bottom contacts, respectively, within said corresponding channels; and a stuffer received at said rear end of said housing, said stuffer being configured to retain the at least one flexible cable in contact with said second contact prong.

13. An electrical connector comprising:

a housing having a card slot at a front end configured to receive a circuit board having electrical traces and a top and bottom slot at a rear end configured to receive flexible cables having electrical traces;

top and bottom contacts retained in alignment along a vertical axis in a channel in said housing, said top and bottom contacts each having a first contact prong extending into said card slot that is configured to engage the electrical traces of the circuit board, said top and bottom contacts each having a first U-shaped portion extending away from said first contact prong, said first U-shaped portion including a retention prong and a second contact prong facing one another and spaced apart to frictionally secure the electrical traces of the flexible cables therebetween; and a stuffer received at said rear end of said housing in said top and bottom slots, said stuffer retaining said flexible cables in contact with said second contact prongs.

14. The electrical connector of claim 13, wherein at least one of said top and bottom contacts includes an H-shape partially defined by said first and second contact prongs, and a retention leg that frictionally engages a retention wall in said channel to retain said at least one of said top and bottom contacts therein.

15. The electrical connector of claim 13, wherein at least one of said top and bottom contacts includes an H-shape partially defined by said second contact prong and said retention prong facing one another and spaced apart to frictionally engage a stuffer.

16. The electrical connector of claim 13, wherein said top slot receives one of the flexible cables and a top retention wall of a stuffer, said top contact having a top contact leg and a bottom retention leg aligned along said vertical axis in said channel, said second contact prong extending from said top contact leg into said top slot to engage the flexible cables and said retention prong extending from said bottom retention leg into said top slot to engage said top retention wall.

17. The electrical connector of claim 13, wherein said bottom slot receives one of the flexible cables and a bottom retention wall of a stuffer, said bottom contact having a bottom contact leg and top retention leg aligned along said vertical axis in said channel, said second contact prong extending from said bottom contact leg into said bottom slot to engage the flexible cables and a retention prong extending from said top retention leg into said bottom slot to engage said bottom retention wall.

18. The electrical connector of claim 13, wherein said top contact includes a bottom contact leg having said first contact prong and said bottom contact includes a top contact leg having said first contact prong, said first contact prongs of said bottom contact leg and top contact leg extending toward each other into said card slot along said vertical axis and being separated by a distance less than the thickness of the circuit board such that the circuit board pushes said bottom contact leg toward a top retention wall and said top contact leg toward a bottom retention wall as said first contact prongs engage the electrical traces on the circuit board.

19. The electrical connector of claim 13, wherein said top and bottom contacts each include an H-shape defined by said first U-shaped portion opposite a second U-shaped portion, said second U-shaped portion including a retention leg and said first contact prong extending away from said retention leg, said retention leg frictionally engaging said housing to retain said top and bottom contacts therein.

20. The electrical connector of claim 13, wherein said housing includes a plurality of said channels, said channels being parallel to one another and aligned to receive corresponding top and bottom contacts.

21. The electrical connector of claim 13, wherein said top and bottom slots in said housing are parallel and overlaid and are oriented transversely with respect to said channel.

* * * * *